US005250246A

United States Patent [19]

Totsuka

[11] Patent Number: 5,250,246

[45] Date of Patent: Oct. 5, 1993

[54] METHOD AND APPARATUS FOR MANUFACTURING SHEETS

[75] Inventor: Akio Totsuka, Chiba, Japan

[73] Assignee: Nippon Petrochemicals Co., Ltd., Tokyo, Japan

[21] Appl. No.: 614,724

[22] Filed: Nov. 16, 1990

[30] Foreign Application Priority Data

Nov. 22, 1989 [JP] Japan ..... 1-302230

[51] Int. Cl.[5] ..... B26D 3/10; B26F 1/38

[52] U.S. Cl. ..... 264/138; 83/36; 83/268; 264/163; 425/304; 493/363; 493/372; 493/965

[58] Field of Search ..... 264/138, 163, 284, 293; 425/297, 302.1, 304, 305.1, 385; 83/13, 39, 23, 14, 36, 268, 467.1, 468.6; 493/363, 364, 372, 964, 965

[56] References Cited

U.S. PATENT DOCUMENTS

| | | | |
|---|---|---|---|
| 3,000,430 | 9/1961 | Ganz et al. | 156/264 |
| 3,330,001 | 7/1967 | Paul et al. | 425/304 |
| 3,381,068 | 4/1968 | Leiper et al. | 425/304 |
| 4,308,005 | 12/1981 | Zundel | 425/304 |
| 4,767,393 | 8/1988 | Smith | 83/92 |

FOREIGN PATENT DOCUMENTS

| | | |
|---|---|---|
| 1944464 | 9/1970 | Fed. Rep. of Germany . |
| 2182596 | 5/1987 | United Kingdom . |
| 2219235 | 6/1989 | United Kingdom . |

*Primary Examiner*—Jay H. Woo
*Assistant Examiner*—James P. Mackey
*Attorney, Agent, or Firm*—Bucknam and Archer

[57] ABSTRACT

A method of manufacturing pallets from sheets of substantially the same dimensions as the dimensions of the pallets to be manufactured by the steps of sequentially feeding sheets of a predetermined polygonal shape, cutting substantially at one time a plurality of corner portions of the thus fed sheets to obtain pallets and then discharging the thus obtained pallets. Belt conveyors sequentially feed sheets of a predetermined polygonal shape and cutting dies cut substantially at one time the rear corner portions of the preceding sheet and the front corner portions of the following sheet to obtain pallets and belt conveyors sequentially discharge the thus obtained pallets. When a ruled line, that is, an elongate recess or the like for bending is needed in the resulting pallets, cutting of the corner portions and formation of the ruled line are effected substantially at one time.

32 Claims, 6 Drawing Sheets

METHOD AND APPARATUS FOR MANUFACTURING SHEETS

BACKGROUND OF THE INVENTION

1. Field of the Invention

This invention relates to a method and an apparatus for manufacturing sheets, such as synthetic resin-made sheet pallets used to mount goods thereon for transport and storage. The invention also relates to a stack of pallets.

2. Prior Art

Various sheets have heretofore been used for various purposes. Such sheets include pallets made of a synthetic resin. The pallets made from a synthetic resin are light in weight and small in size as compared with pallets made of wood, and the former are excellent in loading and storing efficiency. Therefore, the pallets made from sheets of synthetic resin have been widely used.

The prior art pallet made from a sheet of synthetic resin is rectangular in shape. Each corner part of the pallet is circularly arcuate in shape. In the vicinity of one side edge of the surface of the pallet, a ruled line (for example, an elongate recess) is formed. The elongate recess is parallel to the one side edge. The elongate recess is a recessed groove, which is used for bending upwardly the portion of the sheet, defined by the groove and the one side edge, to form a tab portion. A load is laid on the top surface of the pallet. In a push-pull apparatus or the like, the pallet loaded thereon with goods is pulled up onto a platen with the tab portion being held, for transporting the goods.

The pallet of this kind has been manufactured by a punching machine for corrugated cardboards, such as disclosed for instance, in Japanese Patent Appln. Laid-Open Gazette No. 85933/1985, U.S. Pat. No. 4,767,393. The shape of knife-edge of the punching machine has been conformed to the shape of the pallet. The prior art punching machine for the sheet pallet has a lower die the top surface of which is flat, and an upper die. The upper die is provided, on the lower side, with a rectangular frame-shaped knife-edge body which matches the external shape of the pallet, and is also provided with a press piece for forming the elongate recess. The sheet pallets have conventionally been formed by punching a sheet material to obtain sheet pallet blanks and then pressing the blanks by this prior art punching machine.

As stated above, the pallets have usually been formed by the rectangular frame-shaped knife-edge body which matches with the external shape of the pallet. Therefore, the sheet material is naturally a little larger than the pallet to be formed. Accordingly, the yield of products is low and this is disadvantageous from the view point of the cost of products.

Since the knife-edge body has a rectangular frame-like shape and it occupies a large space accordingly, the machine used must be of large size.

SUMMARY OF THE INVENTION

An object of the present invention is to provide a method and an apparatus which enable the automatic and successive production of sheets such as pallets or tier sheets.

Another object of the present invention is to provide a method and an apparatus which permit to improve the yield of products and reduction of the manufacturing cost.

Still another object of the present invention is to provide a method of manufacturing pallets which allows the use of a small sized or compact apparatus for carrying out the method, and also to provide the small sized apparatus.

In a first aspect of the present invention, the method for manufacturing sheets according to the present invention comprises the steps of feeding a sheet material having a predetermined polygonal shape, cutting collectively (in a lump), that is substantially simultaneously, a plurality of corner portions of the fed sheet material to obtain sheets and discharging the thus obtained sheets.

In a second aspect of the present invention, the method for manufacturing sheets according to the present invention comprises the steps of sequentially feeding sheet materials having a predetermined polygonal shape, cutting at one time the rear corner portions of the first fed sheet material and the front corner portions of the subsequently fed sheet material to obtain sheets and then sequentially discharging the thus obtained sheets.

In a third aspect of the present invention, the method for manufacturing sheets according to the present invention comprises the steps of cutting the corner portions of a sheet material having a predetermined polygonal shape and forming a groove for bending the sheet material, the cutting and forming being carried out at one step.

In a fourth aspect of the present invention, the apparatus for manufacturing sheets according to the present invention comprises means for feeding a sheet material having a predetermined polygonal shape, means for cutting at one time a plurality of corner portions of the fed sheet material to obtain a sheet and means for discharging the thus obtained sheet.

In a fifth aspect of the present invention, the apparatus for manufacturing sheets according to the present invention comprises means for sequentially feeding sheet materials having a predetermined polygonal shape, means for cutting at one time the rear corner portions of the fed sheet material and the front corner portions of the subsequently fed sheet material to obtain sheets and means for sequentially discharging the thus obtained sheets.

In a sixth aspect of the present invention, the apparatus for manufacturing sheets according to the present invention comprises a cutting member for cutting the corner portions of a sheet material having a predetermined polygonal shape, a forming member for forming an elongate recess in the sheet material for bending said material and driving means for effecting the cutting of the sheet material and the formation of the elongate recess at the same time.

In the method for manufacturing sheets and the apparatus therefor according to the present invention, only the corner portions of the sheet material are cut off, while the sheet material is not cut along its entire periphery. Besides, a plurality of corner portions of the preceding and the sheet materials which are fed sequentially are cut under such conditions that these sheet materials are set in proximity to each other. In addition, cutting of the corner portions and formation of the groove are effected at the same time. Furthermore, the corner portions and the like of sheet materials are machined in the course of conveyance of the sheet materials.

DESCRIPTION OF THE PREFERRED EMBODIMENTS

The embodiments of this invention will be described hereinbelow with reference to FIGS. 1 to 8.

Figure 1:
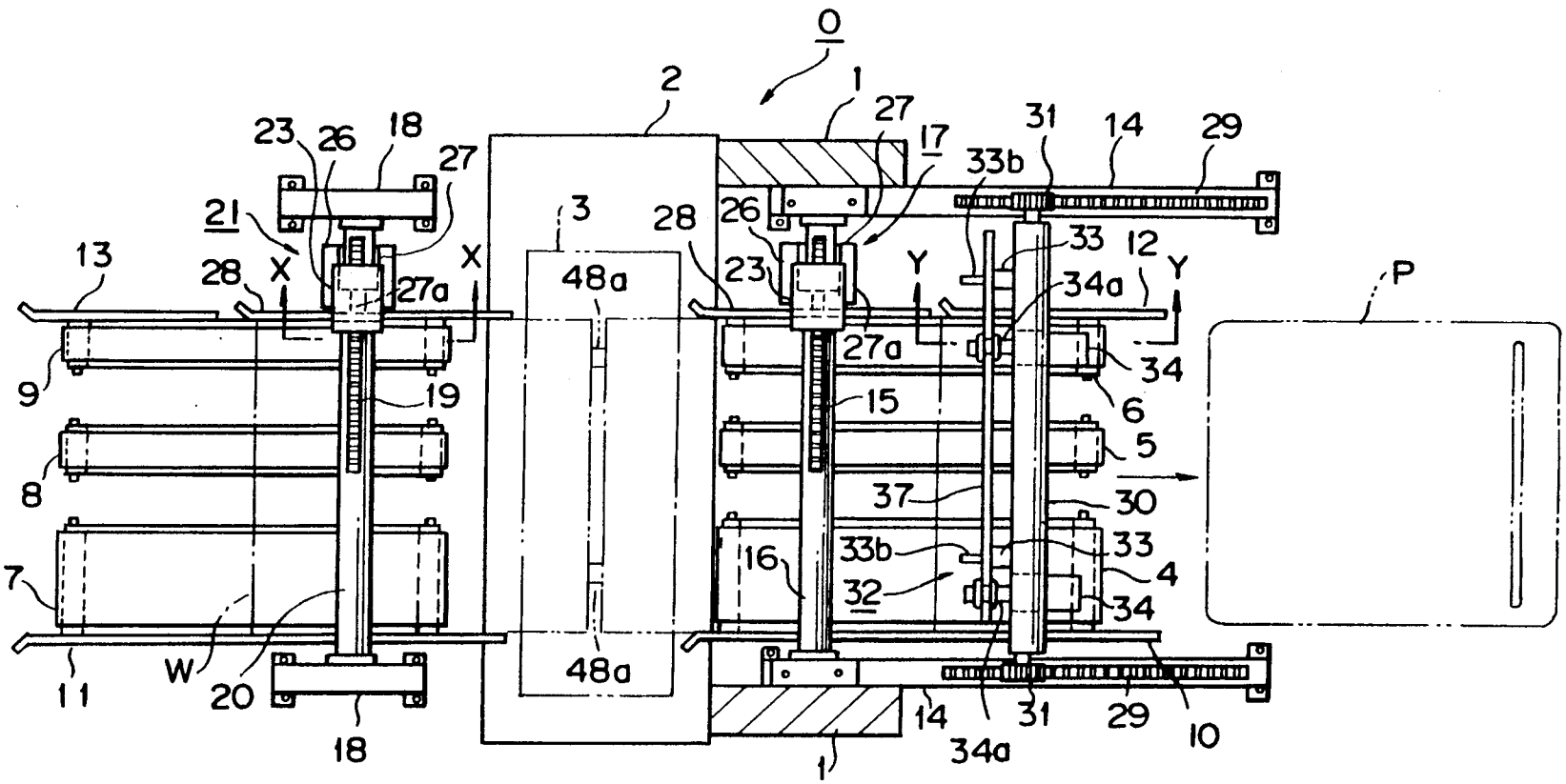
FIG. 1 is a plan view of the first embodiment of an apparatus of the present invention.

In FIG. 1, numerals 1, 1 designate the frame of a machining apparatus 0, and numeral 2 designates the table of the machining apparatus 0. The upper and lower dies 3, details of which will be described later, are set on the table 2.

A sheet material W is conveyed from the left side of the figure to the right side, during which the sheet material is formed into a sheet. The side toward which the sheet is conveyed, the right side of the figure and the downstream side is called the front side, while the side opposite to the above, i.e. the left side of the figure and the upstream side is called the rear side.

On the rear side of the table 2, i.e. on the left side of the figure, three belt conveyors, 7, 8, 9 are the feeding means for feeding the sheet material. On the front side of the table 2, i.e. on the right side of the figure, three belt conveyors, 4, 5, 6 are the discharging means for discharging the sheet. The respective top surfaces of the belt conveyors, 4, 5, 6, 7, 8, 9 are substantially flush with the surface of the dies 3.

The conveyors, 5, 6, 8 and 9 which are narrower than belt conveyors 4 and 7 are so designed that they can be shifted laterally, that is, onto the right side or the left side with respect to the direction of advance of the sheet material in accordance with the size of a sheet material W fed.

Numerals 10, 11 designate fixed guides which are long in the longitudinal direction and control or restrict the shift of the sheet material W in the lateral direction, that is, onto the right side of the sheet material W. The fixed guide 10 is fixed to a frame located on the right side of the wider belt conveyor 4 on the front end. The fixed guide 11 is fixed to a frame located on the right side of the wider belt conveyor 7 on the rear end. The upper edges of the fixed guides 10, 11 are somewhat higher than the top surfaces of the belt conveyors 4, 7.

Numerals 12, 13 designate similar guides pairing respectively with the fixed guides 10, 11. The guides 12, 13 guide the sheet material W before machining and after machining. The guide 12 is fixed to the front end of a frame located on the left side of the front belt conveyor 6 provided on the left side with respect to the direction of advance of the sheet. The guide 13 is fixed to the rear end of a frame located on the left side of the belt conveyor 9 on the rear end. The guides 12, 13 are shifted laterally in accordance with the shift of the conveyors 6, 9.

When the sheet material W is so small in width as to be beyond the extent of the shift of the belt conveyors 6, 9 and therefore cannot be guided by the guides 12, 13, the following measures are taken. Similar guides (not shown in the figure) as the above are fitted to frames on the left side of the belt conveyors 5, 8 installed in the center, respectively. These guides may be designed to be removable and it is advisable that these guides be made removable in the lateral direction with respect to the direction of advance of the sheet.

Numerals 14, 14 designate a pair of elongate holders provided of on the right and the left, which extend from the floor surface inside the frames 1, 1. A guide shaft 16 is supported laterally between the rear end portions of the pair holders 14, 14 respectively on the right and the left of the holders. The guide shaft 16 has a rack 15 on its top flat surface of the required length. The guide shaft 16 is provided with a first positioning device 17 which may be moved in the lateral direction.

In the rear of the table 2 on the floor surface, a pair of right and left holders 18 are provided near the front ends of the belt conveyors 7, 8, 9 for feeding the sheet material. In the same way as the guide shaft 16, a guide shaft 20 is supported laterally between the pair of right and left holders 18, 18. The guide shaft 20 has a rack 19 on its top flat surface of the required length. The guide shaft 20 is provided with a second positioning device 21 which has substantially the same construction as the first positioning device 17 and which may be moved laterally.

Figure 2:
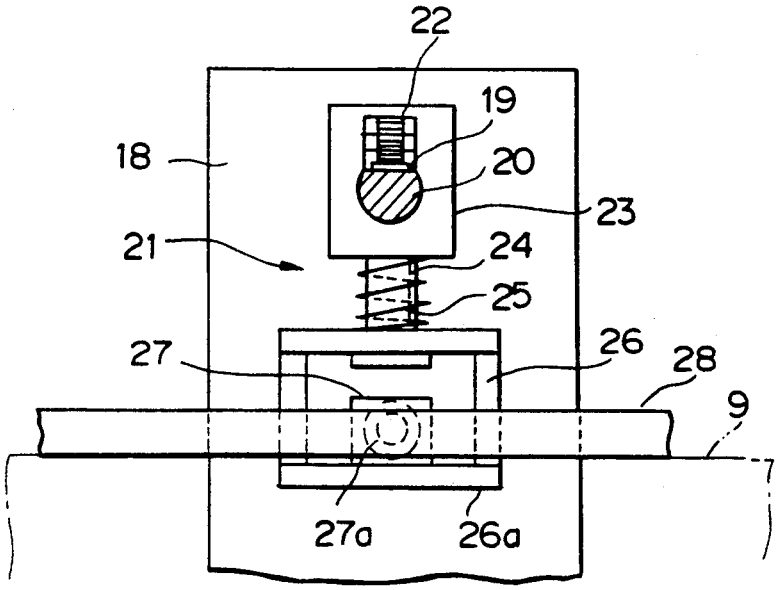
FIG. 2 is a side view of the longitudinal section of a principal part taken along the line X—X in FIG. 1.

The second positioning device 21 is constructed as shown in FIG. 2. The device has a slider 23 which is fitted slidably on the guide shaft 20. The slider 23 is fitted with a pinion 22 moving in the lateral direction. The pinion 22 gears with the rack 19. A support shaft 24 is suspended from the lower end of the slider 23. A compression coil spring 25 is coiled on this support shaft 24. At the lower end of the support shaft 24, a support 26 having square sides and being frame-like is hung so that it can move vertically. An air cylinder 27 is mounted on the bottom piece 26*a* of the support frame 26. The moving guide 28 of the required length is fixed at about the middle, to the fore end of piston rod 27*a*. The moving guide 28 is provided in parallel to the above-mentioned fixed guide 11. The moving guide 28 can be moved with respect to the top surface of the belt conveyor 9 or 8 toward the fixed guide 11.

The moving guide 28 and the fixed guide 11 with which this moving guide pairs, press the opposite sides of the sheet material W so that the sheet material may be stabilized. When a sheet material having a different width is used, the slider 23 is moved in the lateral direction along the guide shaft 20, whereby the relative width between the fixed guide 11 and the moving guide 28 may be adjusted.

When it is desired to move the support frame 26 and the moving guide 28 which is integral with this frame beyond the belt conveyor 9 or 8, it is only necessary to lift the entire support frame 26 upwardly against the compression coil spring 25.

The first positioning device 17 has substantially the same construction as the above-mentioned second positioning device 21 and conducts the same operation as the latter. Therefore the components of the first positioning device 17 which are the same as those of the second positioning device 21, are given the same numerals so that a detailed description of the device 17 is omitted.

With reference to FIG. 1, racks 29, 29 are fixed on the top surfaces the holders 14, 14 and extend from about the middle of the holders over to the front end parts respectively. Pinions 31, 31 gear with the two racks 29, 29 respectively. These pinions are supported axially at the opposite right and left ends of a support 30 carried horizontally between the holders 14, 14.

A push-back device 32 is fixed to the support 30. The push-back device 32 pushes back the sheet material W conveyed by the belt conveyors 4, 5, 6 for discharging a sheet, towards the dies 3 in the rear.

Figure 3:
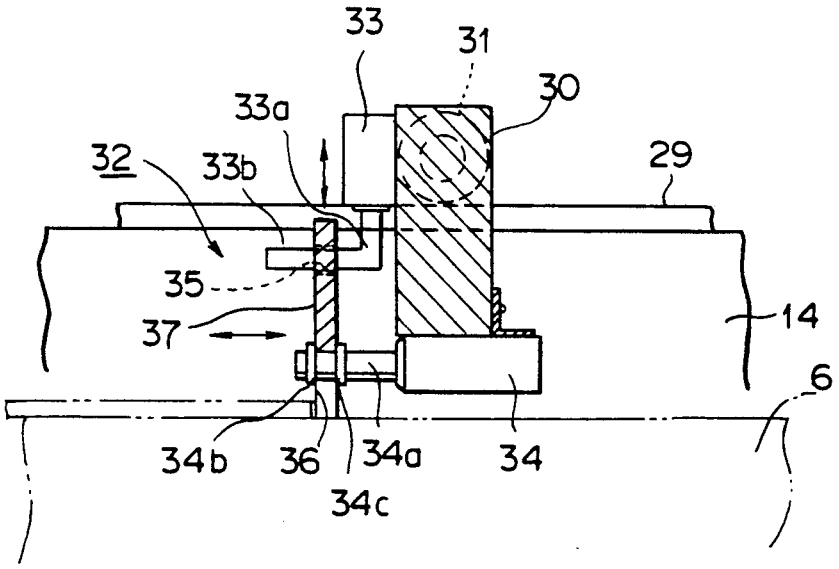
FIG. 3 is a side view of the longitudinal section of the principal part taken along the line Y—Y in FIG. 1.

The push-back device 32 is constructed as shown in FIG. 3. The push-back device 32 has a pair of air cylinders 33, 33 provided at the right and the left for elevation. The air cylinders 33, 33 are fixed on the surface of the rear part of the support 30. Piston rods 33*a*, 33*a* of the air cylinders 33, 33 project downward. To the front ends of the piston rods 33*a*, 33*a*, pull-up rods 33*b*, 33*b* are fitted so that they face the rear of the apparatus. On the lower side of the support 30, a pair of right and left air cylinders 34, 34 are fixed for pushing back. Piston rods 34*a*, 34*a* of the air cylinders 34, 34 protrude towards the rear. In the rear of the support 30, a gate plate 37 is provided. The gate plate 37 is parallel to the support 30. In the upper part of the gate plate 37, a pair of right and left through holes 35, 35 are made. The pull-up rods 33*b*, 33*b* are inserted freely through the right and left through holes 35, 35 respectively. A pair of longitudinally long holes 36, 36 are made at the right and the left in the lower part of the gate plate 37. The respective piston rods 34*a*, 34*a* of the two air cylinders 34, 34 for push back are inserted freely through the pair of longitudinally-long holes 36, 36 on the right and the left. Retainer fittings 34*b*, 34*c* are fixed to the piston rods 34*a*, 34*a*. The retainer fittings 34*b*, 34*c* are ring-shaped. The diameter of the outer circumference of each of the retainer fittings 34*b*, 34*c* is larger than the lateral width of the longitudinally-long hole 36.

The gate plate 37 is elevated when the piston rods 33*a*, 33*a* are pulled up by the operation of the air cylinders 33, 33 for elevation and is lowered when the piston rods 33*a*, 33*a* are pulled down. When the gate plate 37 is lowered, its lower end surface is at its lowermost position in proximity to the respective top surfaces of the belt conveyors 4, 5, 6, but this lowermost position near the surfaces of these conveyors is at the same time the upper limit position of the belt conveyors thus allowing the sheet material W to pass through thereunder.

Since the piston rods 34*a*, 34*a* are inserted freely through the longitudinally-long holes 36 of the gate plate 37, the gate plate 37 can be elevated and lowered without any hindrance.

The pull-up rods 33*b*, 33*b* are inserted freely through the through holes 35, 35 of the gate plate 37, and therefore the gate plate 37 moves in the longitudinal direction, that is, the right or left direction of FIG. 3 while being guided by the pull-up rods 33*b*. Since the retainer fittings 34*b*, 34*c* are fixed to the piston rods 34*a* with the gate plate 37 held therebetween and the position rods 34*a* are inserted freely through the longitudinally-long hole 36 of the gate plate 37, the movement of the gate plate 37 in the longitudinal direction is regulated by the piston rod 34*a*. By making the push-back air cylinders 34 operate, accordingly, the gate plate 37 can be moved just above the top surfaces of the belt conveyors 4, 5, 6 in the longitudinal direction without any hindrance.

Next, the dies 3 will be described in detail.

Figure 4:
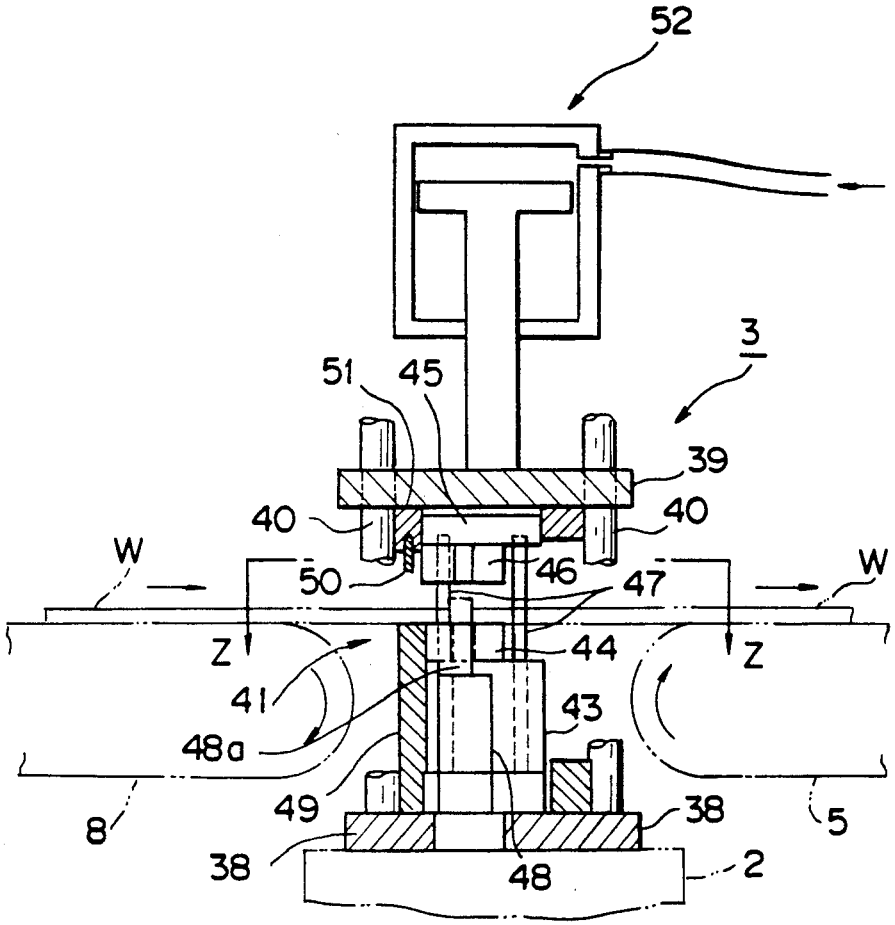
FIG. 4 is a right side view of the longitudinal section of the center of a die.
Figure 5:
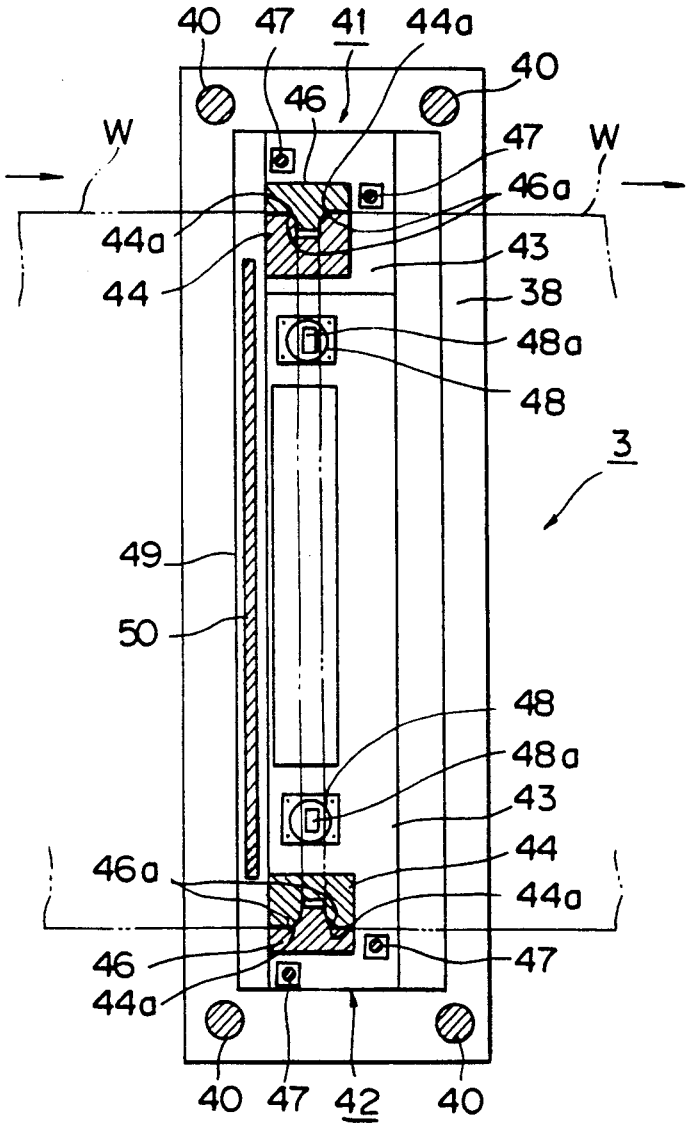
FIG. 5 is a horizontal plan view of the longitudinal section of a principal part taken along the line Z—Z in FIG. 4.

In FIGS. 4 and 5, numeral 38 denotes a fixed base set on the table 2 in the machining apparatus 0. Numeral 39 designates a base (driving means) which is fitted to a ram 52 and is movable in the vertical direction. These two bases 38, 39 are positioned to each other by means of four poles 40, 40 disposed at the opposite right and left sides of the bases. The two bases 38, 39 are integrated in a unit.

Numerals 41, 42 designate die sets provided at the opposite sides between the upper and lower bases 38, 39. The die sets 41, 42 are respectively provided symmetrically at the right and the left of the die sets. The die sets 41, 42 have cutting means, that is lower and upper knife edges 44 and 46 respectively. The lower cutting member knife edge 44 is fixed on the top surface of a lower die holder 43 mounted on the fixed base 38. The lower knife edge 44 is provided with cutting edge faces 44*a*, 44*a* shaped like circular arcs curved towards the front and the rear respectively. The lower knife edge 44 is substantially a recess in shape in the plan view of FIG. 5. The upper knife edge or cutting member 46 is fixed on the bottom surface of the upper die holder 45 provided just under the movable base 39. The upper knife edge 46 is provided with cutting edge faces 46*a*, 46*a* which match with the above-mentioned circular arc cutting edge faces 44A, 44A. The upper knife edge 46 is a protrusion in the plan view of FIG. 5.

Numerals 47, 47 designate guide poles which extend upwardly between the upper and lower die holders 43 and 45. The movable base 39 is pushed down by the ram 52. The ram 52 has hydraulic cylinder and a piston. When the movable base 39 is pushed down, the upper die holders 45 are lowered while being guided by the guide poles 47, 47. By the lowering of the die holder 45, the upper knife edge 46 and the lower knife edge 44 are caused to engage with each other, whereby the corner portions of the sheet material W are cut by a shearing action.

The die set 42 at its left side is movable in the lateral direction thereby enabling it to perform its function even when sheet material W having a different width is fed.

Numerals 48*a*, 48*a* designate stoppers for the sheet material located in the interior of the lower knife edges 44 and the upper knife edge 46 at the right and the left respectively. The stoppers 48*a*, 48*a* are provided on the center lines connecting the lower knife edge 44 and the upper knife edge 46 at the right and the left respectively. The stoppers 48*a*, 48*a* are a pair of right and left piston rods shaped like a square pillar. These piston rods 48*a*, 48*a* are moved vertically by the action of air cylinders 48, 48. When the piston rod 48*a* moves upwardly, it projects above the level of the lower knife edge 44. When the piston rod 48*a* moves downwardly, it moves back below the level of the lower knife edge 44. The front or rear end of the sheet material W can be brought into contact with the piston rod 48*a*, that is the stopper, when the piston rod 48*a* projects above the level of the lower knife edge 44.

The size of the piston rod 48*a* in the longitudinal direction is adjusted according to the size of the sheet material. When the piston rod 48*a* comes in contact with the front or rear end of the sheet material W, each corner portion of the sheet material W is positioned above the lower knife edge 44 on the right or the left and just below the cutting edge face 46*a* of the upper knife edge 46.

A bearing block 49 is fixed on the fixed base 38, in the rear of the lower die holder 43. The bearing block 49 is flush with the lower knife edge 44. On the bottom surface of the movable base 39 facing the bearing block 49, an upper tool 51 is fixed, the latter being provided with a presser body 50 which is an elongated recess-forming member. By means of the presser body 50 and the bearing block 49, an elongate recess for bending, such as a recessed groove, is formed in the surface of the sheet material W.

A description of the method of manufacture of a pallet from the sheet material of a synthetic resin by employing the above described punching device follows. The sheet material W is polygonal, e.g. rectangular, in shape before being machined. The sheet material W is one which has beforehand been cut in conformity with the external dimensions of the pallet to be manufactured.

Prior to the machining of the sheet material W, first, the positions in the lateral direction of the guides 12, 13 and the first and second positioning devices 17, 21 are properly set beforehand in conformity with the width of the sheet material W as shown in FIG. 1. Likewise, the position of the push-back device 32 in the longitudinal direction is properly set beforehand in conformity with the length of the aforesaid sheet material W. Besides, the gate plate 37 of the push-back device 32 is lowered. Moreover, the piston rod 48*a* of the air cylinder 48 provided in the die set 41 is made to project.

A first sheet material W is delivered from a sheet material stocker (not shown). The first sheet material W so delivered is transferred forward by the belt conveyors 7, 8, 9 for feeding the sheet material. The front end of the first sheet material W comes into contact with the piston rod 48*a* which has been made to project beforehand. When the contact occurs, the belt conveyors 7, 8, 9 are stopped. Simultaneously, the air cylinder 27 of the second positioning device 21 is actuated. When the air cylinder 27 operates, the movable guide 28 presses the sheet material W at the right so as to fix the sheet material W in an immovable state by the movable guide 28 and the fixed guide 11.

At this time, both the corner portions of the front of the sheet material W are positioned automatically between the cutting edge face 44*a* on the rear side of the lower knife edge 44 and the cutting edge face 46*a* on the rear side of the upper knife edge 46, as shown in FIGS. 4 and 5.

When the ram 52 is operated in this state, the upper knife edge 46 is pushed down. Both corner portions of the sheet material W are cut so that they form circular arcs respectively, due to the action of the upper knife edge 46 being pushed down. In addition, an elongated recess such as a groove is formed in the surface of the front end of the sheet material W due to the strong pressure of the presser body 50.

Subsequently, the movable guide 28 is returned to its initial position and, simultaneously, the piston rod 48*a* is made to move back, so that the sheet material W is released. Then, the belt conveyors 4, 5, 6 for discharging the sheet are operated simultaneously. The sheet material W is transferred forwardly until it comes into contact with the gate plate 37.

Immediately after the rear end of the sheet material W passes the top surface of the piston rod 48*a*, this rod is caused to project again, so as to prepare for the stopping a subsequent sheet material.

When the sheet material W comes into contact with the gate plate 37, the belt conveyors 4, 5, 6 for discharging the sheet will stop at once. Immediately thereafter, the right and left air cylinders 34 for push back will operate whereby the gate plate 37 is moved back until the rear end of the sheet material W comes into contact with the piston rod 48*a*.

In this manner, both rear corner portions of the sheet material W are automatically positioned between the cutting edge face 44*a* in the front of the lower knife edge 44 and the cutting edge face 46*a* in the front of the upper knife edge 46 (see FIG. 5).

Meanwhile, a second sheet material W is fed from the sheet material stocker. The second sheet material W is transferred, in the same manner as the first sheet material, by the belt conveyors 7, 8, 9 for feeding the sheet material, which operate successively. The front end of the second sheet material W comes into contact with the piston rod 48*a*. Then both of the corner portions in the front end of the second sheet material W are positioned between the cutting edge face 44*a* on the rear side of the lower knife edge 44 and the cutting edge face 46*a* on the rear side of the upper knife edge 46. The second sheet material W is caused to stand still.

The above stated step of feeding the second sheet material W is executed substantially simultaneously with the above described operation of pushing back the first sheet material W. At the point when the two sheet materials W come into contact with piston rod 48*a*, the first and second positioning devices 17, 21 will operate so as to respectively fix the two sheet materials W in an immovable state by the front and rear movable guides 28 and the fixed guides 10 and 11.

At this time, the air cylinder 34 for push back contractively moves back and the gate plate 37 returns to the original position. Thereafter the gate plate 37 is elevated to the position allowing the machined sheet material W to pass through, by the operation of the air cylinder 33 for elevation.

In this state the ram 52 is operated to push down the right and left upper knife edges 44. In this matter, both the rear corner portions of the first sheet material W and both front corner portions of the second sheet material W are cut simultaneously so that all the corner portions so cut form circular arcs respectively. At the same time, an elongated recess such as a recessed groove, is formed in the surface of the front end of the second sheet material W by the presser body 50.

Subsequently, movable guides 28 of the first and second positioning devices 17, 21 are returned to their initial positions. The piston rods 48*a* are contractively moved back simultaneously. Then, the front and rear belt conveyors 4, 5, 6 and 7, 8, 9 are driven. The first sheet material W of which the machining has ended, i.e. a manufactured pallet P, is passed under the gate plate 37 which is beforehand elevated and made to stand still and the sheet is conveyed to a prescribed place (see FIG. 1).

The gate plate 37 lowered just after the first sheet material W passes. The gate plate 37 which is lowered permits advance of the second sheet material W transferred onto the side of the belt conveyors 4, 5, 6 for discharging the sheet.

At this time, a third sheet material delivered from the sheet material stocker is already in contact with the piston rod 48*a*. With the same steps as described above, the rear corner portions of the second sheet material W and the front corner portions and the elongated recess of the third sheet material are machined simultaneously.

By repeating the above described steps, the sheet pallet P can be manufactured in succession.

Figure 6:
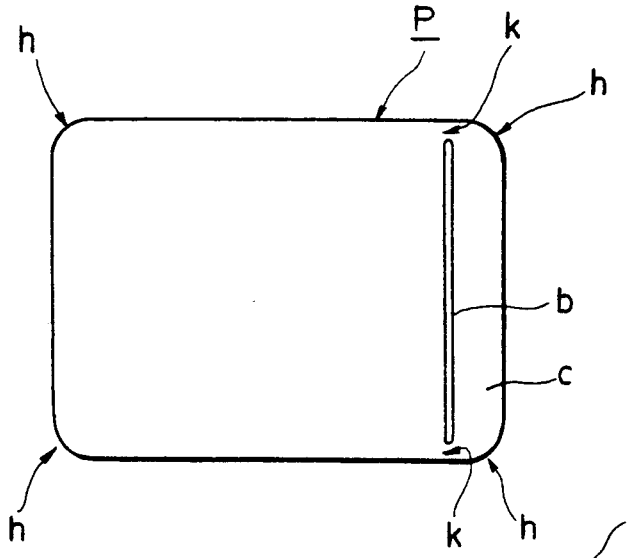
FIG. 6 is a plan view of a pallet P punched by the apparatus of FIG. 1.

FIG. 6 shows the pallet P manufactured by the above described steps. The pallet P has a circular arc shaped surface in each corner portion h. Besides, this sheet pallet P has an elongated recess, specifically a recessed groove b formed along the direction of the width in the surface of the front end part of the pallet. The elongate recess b is formed by pressing without heating the sheet material W. Thus, the thickness of the sheet in the portion of the elongated recess b has decreased, but the density in this position has increased. Therefore the strength of this portion of the elongated recess b is not substantially less.

As shown in FIG. 5, the length of the presser body 50 for forming the elongated recess is smaller than the width of the sheet material W. Accordingly, as shown in FIG. 6, the elongated recess does not extend to the portion k defined by each of the ends of the elongated recess b and the outer periphery of the sheet P. In the prior art sheet, in contrast, the elongated recess extends to the outer periphery of the sheet. The sheet manufactured by the above described steps according to the present invention has the part k and, therefore, has a greater strength than the prior art sheet.

As described above, according to the present invention, the sheet material W is cut only at the corners thereof, not at the entire periphery and therefore the yield is greatly improved and the cost of manufacture is reduced.

Since the corner portions are machined substantially simultaneously with the formation of the elongated recess, productivity of the product sheets is improved.

Since the respective front and rear corner portions of two successive sheet materials W that is, the preceding and following ones, are cut collectively, that is, substantially simultaneously, the corner portions of these sheet materials can be cut at a time when the corner portions are in a proximity to one another. Therefore, the corner portions can be cut at the same time without need of an increased space for accommodating the lower knife edge 44 and the upper knife edge 46, so as to enable the use of a sheet manufacturing apparatus which is smaller in size.

In addition, since the corner portions are machined substantially simultaneously with the formation of the elongated recess in the course of conveyance of the sheet material W, the sheets can be manufactured automatically and successively.

Further, since the corner portions of the sheet material W are cut by the shearing action of the lower knife edge 44 and the upper knife edge 46, the corner portions can be completely cut. Accordingly, the pallet can be produced automatically and successively with little labor in the manufacturing steps as compared with the case in which such cutting is conducted, for example, a press action, and, consequently the productivity can be improved. According to the press cutting in the prior art, the edge of the knife edge body did not reach the lower die completely through the sheet material when it was attempted to cause to cut through the sheet material, and consequently the pallet after punching could not be separated completely from the sheet material. This necessitated a human hands for cutting off, thus wasting labor and reducing productivity.

Furthermore, according to the present invention, the lower knife edge 44 and the upper knife edge 46 do not come into direct contact with each other when the cutting is carried out by the shearing action, and therefore the cycle of replacement of the two knife edges and their lifetime can be prolonged.

The present invention is not limited to the above-described embodiment, and modifications may be made within the scope of the invention.

For instance, the bearing block 49 and presser body 50 for forming the elongated recess in the surface of the sheet material W may be provided in front of the die set 49 so as to form the elongated recess on the rear side of the sheet material W. Also, they may be provided both in the front and in the rear so as to form recessed grooves in two places, that is, the front and rear parts of the sheet material W.

While there has been made a description of an apparatus for manufacturing the sheet pallets in the above embodiment, the present invention is not limited thereto, and it may also be applied to an apparatus for manufacturing for instance, sheets. In this case, it is unnecessary to form the elongated recess for bending in the tier sheet.

Figure 7:
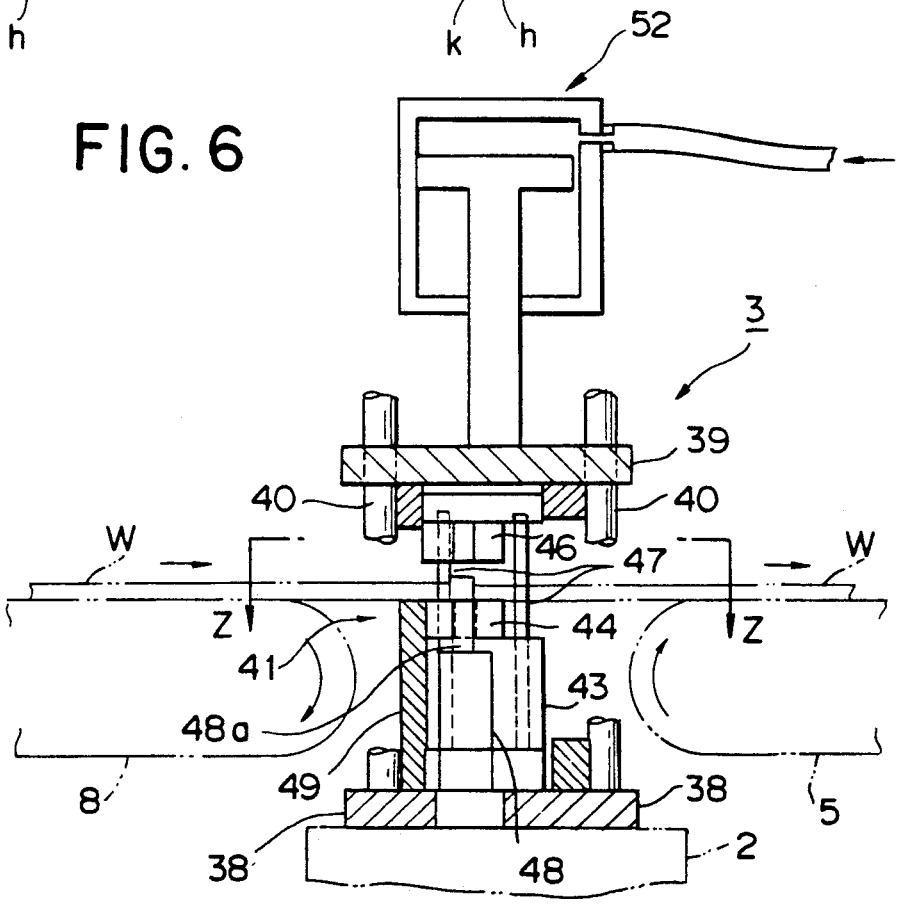
FIG. 7 is a right side view of the longitudinal section of the center of a die of an apparatus according to a second embodiment of the present invention.
Figure 8:
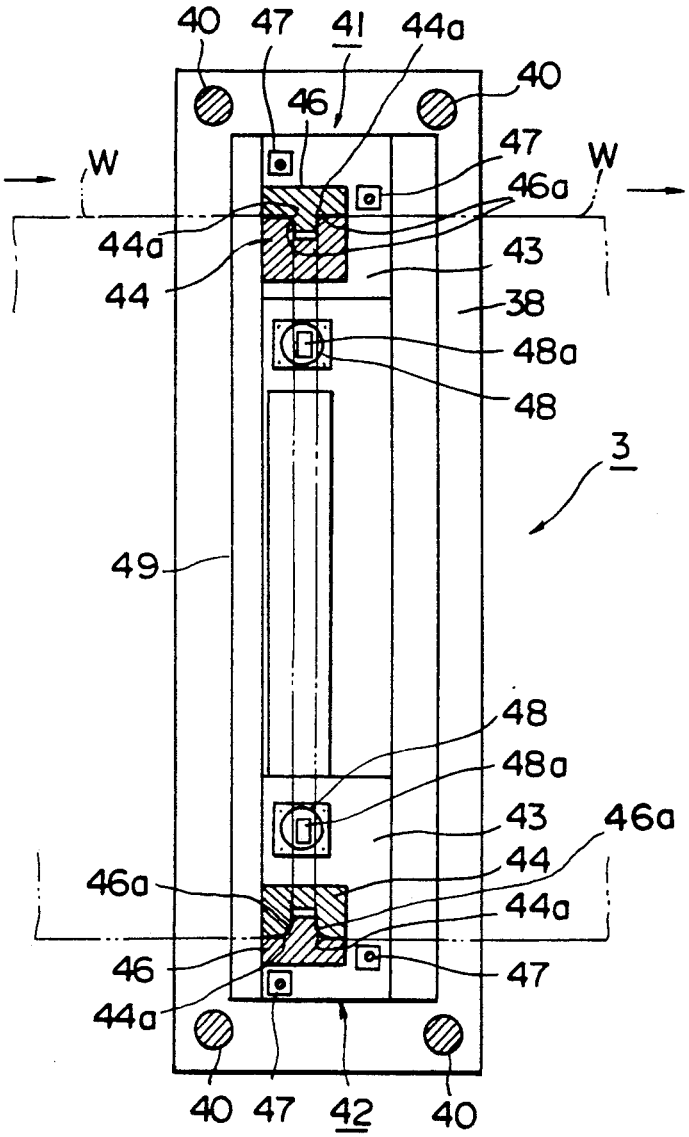
FIG. 8 is a horizontal plan view of the longitudinal section of the principal part taken along the line Z—Z in FIG. 7.

FIG. 7 is a right side view of a longitudinal section of the center of a die of the apparatus for manufacturing the tier sheets, which apparatus is a second embodiment of the present invention, and FIG. 8 is a horizontal plan view of a longitudinal section of a principal part taken along the line Z—Z in FIG. 7. The apparatus of FIGS. 7 and 8 is the same as the apparatus of FIGS. 4 and 5 but the presser body 50 has been removed. Thus the construction except for body 50 is identical to that of the apparatus of FIGS. 4 and 5. The operations and actions of the apparatus are the same as those of the first embodiment described above, excepting that the elongated recess b is not formed in the sheet P because of the absence of the presser body 50.

While the corner portions of the sheet material are cut so that they take the shape of a circular arc in the first and second embodiments described above, the shape is not limited to circular arc. The shapes of the corner portions so cut may be different from each other.

While the sheet material is made of a synthetic resin in the above described embodiment, the present invention is not limited thereto, and the sheet may also be made, of course, of paper, wood, cloth, metal or a combination of these substances.

Moreover, the movable base 39 is pushed down by using the ram 52 having the hydraulic cylinder and the piston, but another push down mechanism may also be employed. For instance, a crank mechanism or the like may also be employed. For instance, a crank mechanism or the like may also be employed.

According to the present invention, as described above, since the sheet material is cut only at the corner portions, not at the entire periphery thereof, to obtain a product sheet, the yield of product sheets will be greatly improved and the manufacture cost thereof will be reduced. Further, the corner portions are machined collectively, that is, substantially at the same time, and therefore automatic and successive manufacture of the product sheets can be executed. Machining for the formation of the elongated recess can also be executed simultaneously with the cutting of the corner portions, if necessary. Moreover, the rear corner portions of the sheet material fed previously and the front corner portions of the sheet material fed subsequently are cut essentially at the same time collectively and therefore a plurality of the corner portions of the sheet materials fed previously and subsequently can be cut in proximity to one another. Therefore, the corner portions can be cut without any increase in a space occupied by the cutting means. By the use of this method of cutting, the apparatus can be made smaller. In addition, the corner portions etc. are machined in the course of conveyance of the sheet material, and therefore the sheet can advantageously be produced automatically and successively.

While the present invention is described in the above on the basis of the embodiments thereof, it is not limited to said embodiments. It will be obvious to anyone skilled in the art that a variety of modifications, improvements, combinations, etc., for instance, may be made within the scope of the invention.

What is claimed is:

1. A method of manufacturing pallets from a plurality of sheets, said sheets having a predetermined polygonal shape and dimensions substantially the same as the dimensions of the pallets to be manufactured, said plurality of sheets comprising a first sheet, a second sheet and at least a third sheet; the method comprising:

a first step of substantially cutting at the same time a portion of said first sheet positioned in a first area, said first area having one side, said portion of said first sheet facing one side of a second area, and a portion of said second sheet positioned in said second area, said portion of said second sheet facing said one side of said first area; and a second step of conveying said first sheet from said first area to a discharging area, conveying said second sheet from said second area to said first area, conveying said third sheet from a feeding area to said second area.

2. The method according to claim 1 wherein said plurality of sheets comprises successive sheets and said first step and said second step are repeated with said successive sheets.

3. The method according to claim 1 wherein each of said sheets has a front end and a rear end, the method further comprising a positioning step of positioning substantially at the same time the rear end of said first sheet and the front end of the second sheet.

4. The method according to claim 1 wherein said first step comprises a forming step wherein a recess groove is formed for bending at least one of said first sheet and said second sheet.

5. The method according to claim 4, wherein said cutting step and forming step are carried out substantially at the same time.

6. The method according to claim 5, wherein said recess groove extends along the width of each of said sheets, the length of said groove being less than the entire width of said sheets.

7. The method according to claim 1 wherein said second step comprises a step of positioning said second sheet and said third sheet by stopping said sheets against a stopper.

8. The method according to claim 7, wherein said second step comprises a step of conveying said second sheet from said second area to said first area by passing over said stopper.

9. The method according to claim 7 wherein said second step comprises a step of moving said stopper back to a position which does not hinder the conveyance of said second sheet at a moment when said second sheet is conveyed from said second area to said first area by passing over said stopper.

10. The method according to claim 9, wherein said second step comprises a step of pushing-back said second sheet and stopping it against said stopper, after said second sheet is conveyed from said second area to said first area by passing over said stopper.

11. The method according to claim 1, wherein each sheet has a front end and a rear end, the method further comprising a step of feeding said first sheet ahead to the position of a stopper, a step of projecting said stopper and a step of positioning substantially at the same time the rear end of said first sheet and the front end of the second sheet by means of said stopper.

12. A method of manufacturing pallets comprising the steps of 1) sequentially feeding a plurality of sheets, said plurality of sheets comprising a first sheet, a second sheet and successive sheets, said plurality of sheets having a predetermined polygonal shape and dimensions substantially the same as the dimensions of the pallets to be manufactured, 2) cutting substantially at the same time not less than one rear corner portion of the first sheet and not less than one front corner portion of the second sheet to obtain pallets, sequentially discharging the thus obtained pallets and repeating said steps 1) and 2) with said successive sheets.

13. The method according to claim 12 wherein said step 1) comprises feeding said plurality of sheets one at a time into an apparatus which has a rear end and a front end, feeding said sheets into said rear end, each of said sheets having front corner portions and rear corner portions; and step 2) comprises cutting the front corner portions of said first sheet; and the method further comprises afterward stopping said first sheet; simultaneously feeding said second sheet and pushing back said first sheet until the front corner portions of said second sheet and the rear corner portions of the first sheet are close to each other; cutting the rear corner portions of said first sheet substantially at the same time at the front corner portions of said second sheet are cut.

14. The method according to claim 13, wherein the sheets have varying width, said sheets are conveyed from said rear end to said front end of the apparatus by means of belt conveyors and the belt conveyors are shifted laterally to adjust to the width of each of the sheets.

15. An apparatus for manufacturing pallets comprising:

a) conveying means for conveying a first sheet and a second sheet in sequence from a feeding position to a second discharging position, said first sheet having a rear side and said second sheet having a front side;

b) positioning means for positioning said first sheet and said second sheet in such a manner that the rear side of said first sheet and the front side of said second sheet face each other at a position adjacent to a predetermined cutting position, said positioning means being located between said feeding position and said discharging position;

c) cutting means for cutting substantially at the same time a portion of the rear side of said first sheet and a portion of the front side of said second sheet.

16. The apparatus according to claim 15, wherein said positioning means comprises a stopper for stopping the rear side of said first sheet and the front side of said second sheet, displacing means for displacing said stopper to a position where the rear side of said first sheet and the front side of said second sheet can be brought into contact with said stopper and to another position where the rear side of said first sheet and the front side of said second sheet cannot be brought into contact with said stopper, and pushing means for pushing said first sheet back to said stopper to push the rear side of said first sheet on to said stopper.

17. The apparatus according to claim 15 wherein each of said first sheet and said second sheet has a front side and a rear side and has a corner portion at the front side and rear side thereof, and said cutting means comprises means for cutting said corner portions.

18. The apparatus according to claim 15 which further comprises a groove-forming means for forming a recessed groove in said first sheet and in the said second sheet for bending said sheets through said recessed groove.

19. The apparatus according to claim 18, wherein said groove has a recessed shape, said groove-forming means comprises a protrusion member having a configuration corresponding to the recessed shape of said groove, and pressing means for pressing said protrusion member in said first sheet and in said second sheet.

20. The apparatus according to claim 15, wherein said cutting means comprises a stationary cutting member, a movable cutting member for cutting in association with said stationary cutting member said portion of said first sheet and said portion of said second sheet by a shearing action thereof, and actuating means for actuating said movable cutting member.

21. The apparatus according to claim 20, which further comprises a protrusion member for forming a recessed groove in said first sheet and in said second sheet for bending said sheets through said recessed groove, and a supporting member supporting said protrusion member and said movable cutting member, said supporting member being adapted to be driven by said actuating means.

22. An apparatus for manufacturing pallets comprising feeding means for sequentially feeding a plurality of sheets having a predetermined polygonal shape and substantially the same dimensions as the dimensions of the pallets to be manufactured, cutting means for cutting substantially at the same time not less than one rear corner portion of a first sheet and not less than one front corner portion of a second sheet to obtain pallets, discharging means for sequentially discharging the thus obtained pallets.

23. The apparatus according to claim 22, wherein said cutting means are in a cutting position for cutting, and the apparatus further comprises stopper means for stopping a sheet in the cutting position, said stopper means being made to move back when a sheet has passed said cutting position and is projected when a sheet is positioned in said cutting position.

24. The apparatus according to claim 22 wherein each sheet has a rear side and a front side the apparatus further comprising positioning means for positioning said first sheet and said second sheet in such a manner that the rear side of said first sheet and the front side of said second sheet face each other at a position adjacent to said cutting means and wherein said positioning means comprises stopping means for stopping a preceding sheet by pushing it back to the stopping means.

25. The apparatus according to claim 22, further comprising a recess groove-forming means for forming a recess groove for bending said sheets.

26. The apparatus according to claim 25 wherein said cutting means perform a cutting motion and said recess groove-forming means comprises means for forming the recess groove simultaneously with said cutting motion by said cutting means.

27. The apparatus according to claim 26, wherein said cutting means comprises not less than one cutting member for cutting not less than one corner portion of a sheet and a first support member for supporting the cutting member, and said recess groove-forming means comprises a recess groove-forming member for forming said recess groove and a second support member for supporting the recess groove-forming member on the first support member.

28. The apparatus according to claim 27 wherein said cutting member comprises a first cutter for cutting the rear corner position of the first sheet and a second cutter for cutting the front corner portion of the second sheet.

29. The apparatus according to claim 22, wherein each sheet has a front end and a rear end and said cutting means are located at a cutting position, the apparatus further comprising positioning means for positioning each sheet in the cutting position, and said positioning means comprises a stop member for stopping the rear end of the first sheet and the front end of the second sheet.

30. The apparatus according to claim 22, wherein each sheet has a front end and a rear end and the apparatus comprises positioning means including stopper means for positioning the rear end of the first sheet and the front end of the second sheet, by contacting said rear end and front end with the stopper means.

31. An apparatus according to claim 22, wherein each sheet has a predetermined width, the apparatus further comprising guide means for guiding each of said sheets, positioning means capable of moving laterally for positioning said guide means and adjusting said guide means to the width of said sheet.

32. The apparatus according to claim 27 which comprises driving means, for actuating said cutting means, a press member and said driving means also actuates said press member, whereby said press member is actuated and forms said recess groove at the same time said cutting means cut said corner portions.

* * * * *